US007013674B2

(12) United States Patent
Kretchmer

(10) Patent No.: US 7,013,674 B2
(45) Date of Patent: Mar. 21, 2006

(54) MAGNETICALLY ATTRACTABLE COMPONENTS FOR SELF-SIZING JEWELRY ARTICLES

(76) Inventor: Steven Kretchmer, Rte. 23 A, Palenville, NY (US) 12463

( * ) Notice: Subject to any disclaimer, the term of this patent is extended or adjusted under 35 U.S.C. 154(b) by 0 days.

(21) Appl. No.: 10/411,619

(22) Filed: Apr. 10, 2003

(65) Prior Publication Data

US 2004/0200235 A1 Oct. 14, 2004

(51) Int. Cl.
*A44C 5/04* (2006.01)

(52) U.S. Cl. ..... 63/5.1; 63/15.1; 63/15.45; 63/15.5; 63/15.7; 446/137; 446/138

(58) Field of Classification Search ..... 63/1.16, 63/1.17, 1.18, 3, 3.1, 3.2, 5.1, 6, 15, 15.1–15.7, 63/15.45, 413, 7, 9, 4, 38, 39, 41; 446/92, 446/137, 138; 59/78, 85
See application file for complete search history.

(56) References Cited

U.S. PATENT DOCUMENTS

| | | | | | |
|---|---|---|---|---|---|
| 486,256 | A | * | 11/1892 | Leehey et al. | 70/15 |
| 2,623,256 | A | * | 12/1952 | Feibelman | 24/303 |
| 3,263,444 | A | * | 8/1966 | Di Croce | 63/15.7 |
| 3,423,956 | A | * | 1/1969 | Manne | 63/15.45 |
| 3,589,341 | A | * | 6/1971 | Krebs | 119/865 |
| 4,221,615 | A | | 9/1980 | Shine | 148/120 |
| 4,853,048 | A | | 8/1989 | Shimizu et al. | 148/300 |
| 4,901,405 | A | * | 2/1990 | Grover et al. | 24/303 |
| 4,905,335 | A | | 3/1990 | Tervola | 7/169 |
| 4,941,236 | A | | 7/1990 | Sherman et al. | 24/303 |
| 4,983,230 | A | | 1/1991 | Overfelt et al. | 148/300 |
| 5,008,984 | A | | 4/1991 | Levy | 24/303 |
| 5,050,276 | A | | 9/1991 | Pemberton | 24/303 |
| 5,097,682 | A | | 3/1992 | Nakamura | 63/14.1 |
| 5,099,659 | A | | 3/1992 | Carranza et al. | 63/2 |
| 5,197,168 | A | | 3/1993 | Levy | 24/303 |
| 5,307,582 | A | | 5/1994 | Quintel | 40/633 |
| 5,311,647 | A | | 5/1994 | Levy | 24/303 |
| 5,317,789 | A | | 6/1994 | Levy | 24/303 |
| 5,323,516 | A | | 6/1994 | Hartmann | 24/303 |
| 5,349,725 | A | | 9/1994 | Levy | 24/303 |
| 5,353,608 | A | | 10/1994 | Berkowitz | 63/1 |
| 5,367,891 | A | * | 11/1994 | Furuyama | 63/29.2 |
| 5,392,497 | A | | 2/1995 | Definer | 24/303 |
| 5,412,956 | A | * | 5/1995 | Levy | 63/15.65 |
| 5,432,986 | A | | 7/1995 | Sexton | 24/303 |

(Continued)

FOREIGN PATENT DOCUMENTS

EP 271423 A1 * 6/1988

(Continued)

*Primary Examiner*—Jack W. Lavinder
(74) *Attorney, Agent, or Firm*—Winston & Strawn LLP

(57) ABSTRACT

A jewelry-forming component composing a body member having a first magnetized portion and a female element associated therewith for magnetically attracting and receiving a male element of another jewelry-forming component. The first magnetized portion of the body member provides a minimum magnetic strength that is sufficient to retain the male element within the female element and a maximum magnetic strength that can be overcome by a person's hand strength to separate the male and female elements. The female element defines a cavity having a depth sufficient to receive the male element at different positions therein, and this allows relative movement of the male and female elements to assist in providing the self-sizing nature of the article. The body member also includes a further element that is magnetically responsive for magnetically coupling with another jewelry-forming component, such that a plurality of such components can be magnetically coupled to form an article of jewelry.

19 Claims, 2 Drawing Sheets

U.S. PATENT DOCUMENTS

| | | | | | |
|---|---|---|---|---|---|
| 5,586,374 | A | * | 12/1996 | Nishida | 24/599.8 |
| 5,664,298 | A | | 9/1997 | Nessar-Ivanovic | 24/303 |
| 5,675,874 | A | | 10/1997 | Chen | 24/303 |
| 5,722,260 | A | * | 3/1998 | Mangano | 63/3.1 |
| 5,806,346 | A | | 9/1998 | Schlinger et al. | 63/40 |
| 5,913,707 | A | | 6/1999 | Roman et al. | 446/131 |
| 5,920,966 | A | | 7/1999 | Chen | 24/303 |
| 5,989,178 | A | | 11/1999 | Chiu | 600/15 |
| 6,116,053 | A | * | 9/2000 | Siebenberg | 63/15 |
| 6,116,982 | A | | 9/2000 | Roman et al. | 446/131 |
| 6,282,760 | B1 | | 9/2001 | Mars | 24/303 |
| 2002/0069670 | A1 | * | 6/2002 | Rosenberg | 63/15.7 |
| 2003/0177787 | A1 | * | 9/2003 | Kuo | 63/15.45 |

FOREIGN PATENT DOCUMENTS

| | | | | |
|---|---|---|---|---|
| GB | 2055552 | A | * | 3/1981 |
| JP | 2002125729 | A | * | 5/2002 |

* cited by examiner

MAGNETICALLY ATTRACTABLE COMPONENTS FOR SELF-SIZING JEWELRY ARTICLES

BACKGROUND ART

The present invention relates to jewelry components that are magnetically attractable to each other so a plurality of such components can be joined or combined into rings, bracelets, chains, chokers, necklaces, watchbands or the like, with the magnetic force holding the components together. Also, components can be connected in any one of a number of positional relationships so that the final jewelry article is self-sizing to the wearer.

When a person wishes to purchase an article of jewelry to be worn, care must be taken to assure that the size of the piece is correct. When purchasing an item such as a bracelet or necklace, the size is selectable from one of a plurality of standard lengths at the desire of the purchaser. Other items, such as watchbands, are provided with removable links so that the size can be selected to conform to the size of the person's wrist. For other items, such as a ring, the jeweler will usually measure the size of the person's finger so that the ring can easily slide along the person's finger into place. It is often difficult to properly size the ring so that it can be snugly maintained in place as it must also be sufficiently large to pass over the person's knuckles, especially for people that have arthritic joints. This means that the ring must be sized larger to accomplish this and then will be too loose when in the proper position. Also, the person's finger can change in size over the years, and a ring that is correctly sized at one time can end up being incorrectly sized in the future.

The accommodation of different sizes creates difficulties for the jewelry manufacturer and seller, in that different sizes must be made available, or specialized orders must be custom made to the person's actual or desired dimensions. It would be desirable to avoid having to carry large inventories of different sized jewelry articles, as well as to avoid having to make custom sized pieces for each customer. These problems are now solved by the present invention.

SUMMARY OF THE INVENTION

The present invention relates to a jewelry-forming component comprising a body member having a first magnetized portion and at least one female element associated therewith for magnetically attracting and receiving a male element of another jewelry-forming component. The first magnetized portion of the body member provides a minimum magnetic strength that is sufficient to retain the male element within the female element and a maximum magnetic strength that can be overcome by a person's hand strength to separate or push apart the male and female elements. The body member also includes a further element that is magnetically responsive for magnetically coupling with another jewelry-forming component, such that a plurality of such components can be magnetically coupled to form an article of jewelry.

The female element may be defined by a cavity having a configuration and depth sufficient to receive the male element at different positional relationships therein, and this allows relative movement between the male and female elements. Advantageously, the body member has an arcuate shape and the female element is located at an end of the arcuate shape. These male and female elements can be matably engaged in the different positions to assist in providing a preferred self-sizing feature to the article.

In one embodiment, the body member has an arcuate shape and first and second female elements are located at each end thereof, with each female element defining a cavity having a depth sufficient to receive a male element at different positional relationships therein. Each female element would be magnetized to attract and hold oppositely polarized male elements therein. The male element can be part of another all male component or a male/female component as described herein.

In another embodiment, the further element is a male element that extends away from the female element and is located on the opposite end of the arcuate shape, wherein the male element has a forward end that is magnetically attracted to the first magnetizable portion of the body member. Thus, a male element of one component is inserted into the female element of another component and the male element of that component is inserted into the female element of another component. This continues until all the components are interconnected and held in magnetic association to form the article.

In yet another embodiment, the further element is another female element that is located on the opposite side of the component. The dual female element jewelry-forming component is magnetized to attract and hold oppositely polarized male elements therein. The male elements may be provided by arcuate rods having ends that are magnetized and that are configured to be received in the ends of the tubular structure. The body of the female component may be magnetized or it may include therein a magnetized pellet or disk member. The male elements are magnetized to an opposite polarity so that magnetic connections can be achieved between the male and female elements. When the female elements are provided as part of a tubular body member, the first magnetized pellet or disk member can be placed within each end of the tubular structure to define the female element cavities.

A jewelry article according to the invention can be provided by combining various combinations of the previously mentioned components or with other magnetized components. The article can be provided in the form of a ring, bracelet, chain, choker, necklace, watchband or other item with a closed or closable continuous configuration and is made from a plurality of jewelry-forming components as described herein. Depending upon the size of the components and the size of the article, any number of these components can be used. For most common sizes, between two and two hundred jewelry-forming components can be connected depending upon the selected size of the component and the desired size of the article. A most preferred article is in the form of a ring, wherein at least two to thirty components are connected end to end to form the article.

A specific embodiment of the invention relates to a jewelry article comprising at least two jewelry-forming components that have a first end and a second end, wherein the first ends of the components are magnetically coupled to the second ends of other components to form an article having a closable or closed, continuous configuration. At least one end of each component is configured to receive the other end of another component in a plurality of positions so that the article is self-sizing to the wearer. As noted above, the jewelry article is preferably in the form of a ring, bracelet, chain, choker, necklace or watchband.

BRIEF DESCRIPTION OF THE DRAWING FIGURES

The invention is more fully understood by reviewing the following detailed description in conjunction with the appended drawing figures, wherein.

DETAILED DESCRIPTION OF THE PREFERRED EMBODIMENTS

Figure 1:
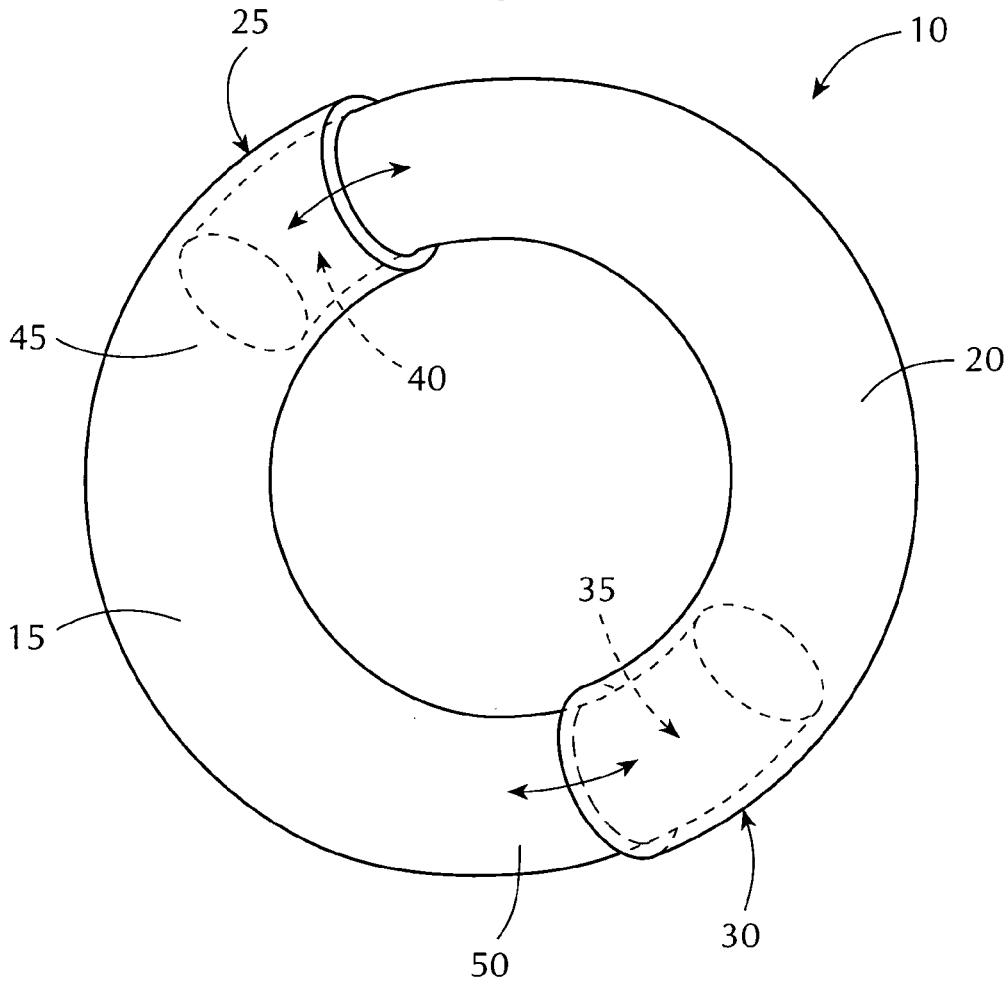
FIG. 1 is an illustration of a ring made of two magnetically mating jewelry-forming components according to the invention.

FIG. 1 illustrates the most simple construction for a self-sizing ring of the invention. The ring 10 is made of two jewelry-forming components 15, 20. Each component is a semi-circle having a female element 25, 30 and a male element 35, 40. The inner diameter of the female element is preferably uniform along its length and is chosen to be slightly larger than the outer diameter of the correspondingly configured male element to allow the male element to move freely into and out of the female element. The interiors of the female elements are shown in phantom lines. Instead of having uniform diameters along their lengths, the male member and female member can have gradually decreasing diameters again configured so that the male element can move freely into and out of the female element.

Any cross sectional configuration of the male and female elements is possible. Although shown as round in the preferred embodiments of these components, other configurations such as polygonal, elliptical or combinations thereof. While the male and female components are preferably of the same configuration, this is not necessary and any matable configurations can be used. Also, the shape of the outer surface of these components is unlimited and can be of any desired shape with or without additional ornamentation, undulations, or other surface characteristics.

It is this movement in combination with the magnetic attraction of the elements that allows the ring to be self-sizing. The movement of the parts is illustrated in FIG. 1 by arrows. The parts are magnetized sufficiently so that male and female elements engage and are magnetically held together. This is easily done by imparting one magnetic force (i.e., either positive or negative) to the body 45 of the component behind the female portion, and by imparting the opposite magnetic force to the male element. Alternatively, one magnetic force can be imparted to the rear portion 50 of the male element, while the opposite magnetic force can be imparted to the female element. In each case, the male and female ends of the components would be attracted to each other, urging the male element into the female element to result in a magnetic connection of the components. The ring is simply and easily formed by simply inserting the male element of each component into the female element of the other component and allowing the magnetic attraction to cause the parts to come together and stay in place.

Figure 2:
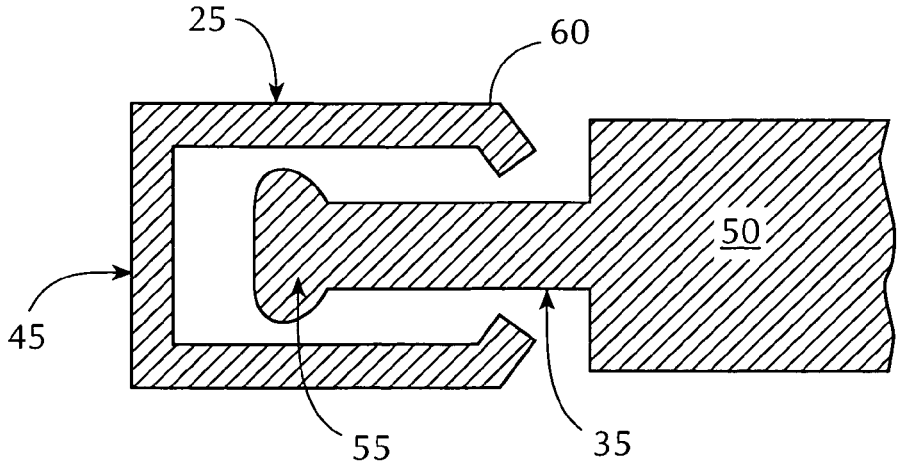
FIG. 2 is an illustration of an example a connection that is resistant to separation for the components of FIG. 1.

In another arrangement, illustrated schematically in cross-section FIG. 2, a more permanent connection between the components of the ring or jewelry piece can be achieved by providing the male elements with a larger head 55 in combination with a crimped or flanged end 60 at the end of the female element. While this structure allows the male element to move within the female element, if prevents the male element from being removed from the female element. Instead of the crimped or flanged end, a pin, screw or the like could simply be provided near the opening of the female element so that, after the male element head is inserted, the pin or screw can be used to prevent the head of the male element from being withdrawn from the female element cavity. Also, the male end can be provided with a groove and snap ring to provide the larger portion that prevents removal of the head from the cavity. Other arrangements for achieving this structure, such as an interlocking design, are well known to skilled artisans and can alternatively be used if desired.

In the most compact state of the ring or jewelry piece, each male element is inserted as far as possible into the female element. A cavity of finite depth can be used so that the forward end of the male element stops by abutting the innermost end of the female element. Alternatively, when a tube or tubular cavity is used as the female element, the rearward portion of the male element can be provided with a shoulder or other protrusion which will act as a stop. These define the smallest size of the piece. Of course, each component can be separated so that a much larger size is provided.

The ring of FIG. 1 is easily slid onto the wearer's finger and expanded over the wearer's knuckle with little effort. The force applied by the user's hands to slide on the ring easily overcomes the appropriate magnetic force between the male and female elements, thus allowing the ring to expand. As the ring is slipped onto the finger of a wearer, the diameter of the finger knuckle, being larger than the inner diameter of the ring, urges the components away from each other. After proper placement at the base of the finger, the magnetic attraction of the male and female elements provides the smallest size that snugly and comfortably conforms to the base of the wearer's finger without compressing or squeezing it. Also, by overcoming the magnetic attraction force, the parts can be slightly separated to accommodate movement over the knuckles or variations of finger diameters to easily put on or take off the ring. This enables the ring to be self-sizing in that it will conform to many different finger sizes as well as facilitate movement over large or arthritic knuckles without pain or effort. A snug but comfortable fit of the ring is provided on the person's finger without having to measure the finger or select particular predetermined ring sizes by trial and error sampling.

"Self-sizing to the wearer" means that the article of jewelry includes jewelry-forming components that in one configuration has magnetically attracted elements that provide a minimum circumference, perimeter or length to the article, but that the elements may be moved relative to each other so that the article can attain a maximum circumference, perimeter or length which facilitates placement of the article around the finger, wrist, ankle, arm, leg, neck or waist of the wearer. Generally, the magnetically attracted components can be separated or moved further apart by the hand strength of the wearer so that a larger size of the article is achieved; and that after placement on the wearer, the elements are magnetically attracted to the extent that a smaller or comfortably snug fit of the article on the wearer is achieved without uncomfortably compressing or squeezing the body part of the wearer.

While the drawing figures utilize rings as preferred examples of jewelry articles that can be made from the magnetic jewelry components of the invention, the skilled artisan would of course recognize that other items, such as bracelets, ankle or belly chains, necklaces or watchbands can be made in the same manner. In those pieces, however, the parts can be designed with a different curvature and a larger number of components would be magnetically joined together to make the piece. As to curvature and overall configuration of the components, anything from a straight to any appropriately curved configuration would be acceptable, and the user could select different combinations depending upon the desired final visual appearance of the article.

As above, different stones, settings or other decorative or ornamental elements can be carried by one or more or even by all of the components. For these types of articles, a clasp or other closure element is not necessarily required as the parts are retained in connection due to magnetic force. Of course, there is no reason why a conventional clasp or other end joining member cannot be used, if desired, for a particular effect.

This connection feature is obtained by providing the mating portions of the components with sufficient magnetic strength so that the elements try to move as closely together as possible. This is conveniently achieved by providing a magnetic strength of between 200 and 4500 Gauss depending upon distances between the parts, types, shapes and sizes of magnets, etc. As the skilled artisan would know, this magnetic strength should be sufficiently low that the elements can be easily separated either by simply sliding the article over the finger, foot, hand, head, legs or torso of the wearer, or by using hand strength to pull apart or expand the article. Depending upon the specific designs utilized, the article can be separated into the jewelry-forming components or the components can be moved to different relative positions, thus enabling the article to temporarily assume an expanded or larger size configuration to facilitate placement on the wearer.

As noted above, the magnetized portion of the body member has a sufficiently high magnetic strength to retain the male member within the female member to hold the jewelry article together, but this magnetic strength is not greater than that provided by the strength of an average person's hands. Thus, the person or wearer of the article has enough strength to retract or pull apart the male member at least partially from within the female member. This enables the size of the article of jewelry to be adjustable to accommodate placement on the wearer. In some designs, if desired or necessary, the components can be disassembled to allow cleaning or rearrangement. Different components can reassembled in a different arrangement, if desired, or can be interchanged with other components of similar size to provide a different appearance to the piece, e.g., by providing different colors, stones or other items to match the clothing or the wearer or to simply provide a different visual effect to the piece.

In a preferred embodiment, the inner surface of the female element has a relatively uniform circumference so that the male element can easily move into or out of the female element. This enables the components to be separated or taken apart for ease of removal or for cleaning. This construction also facilitates reconnection of the components in different combination or with different components to alter or modify the overall appearance of the ring. Although two components are illustrated in FIG. 1, it is within the skill of the art to use any reasonable number of components to create further adjustability to the ring. Depending upon the size of the components and the desired final size of the ring, anywhere between two to as many as thirty or more components can be used. These components can all be of the same size for convenience of manufacture, or one or more or even all of them can be of different sizes, shapes or lengths. As above, different stones, settings or other decorative or ornamental elements can be carried by one or more or even by all of the components. The components can be combinable in a specific sequence, with the sizes selected or configured so that only one connection arrangement is possible, or they can be sized to be interchangeable to enable the user to change the appearance of the ring by assembling the components in a different order or arrangement. One of ordinary skill in the art can devise numerous jewelry arrangements and configurations now that these jewelry-forming components have been developed.

Figure 3:
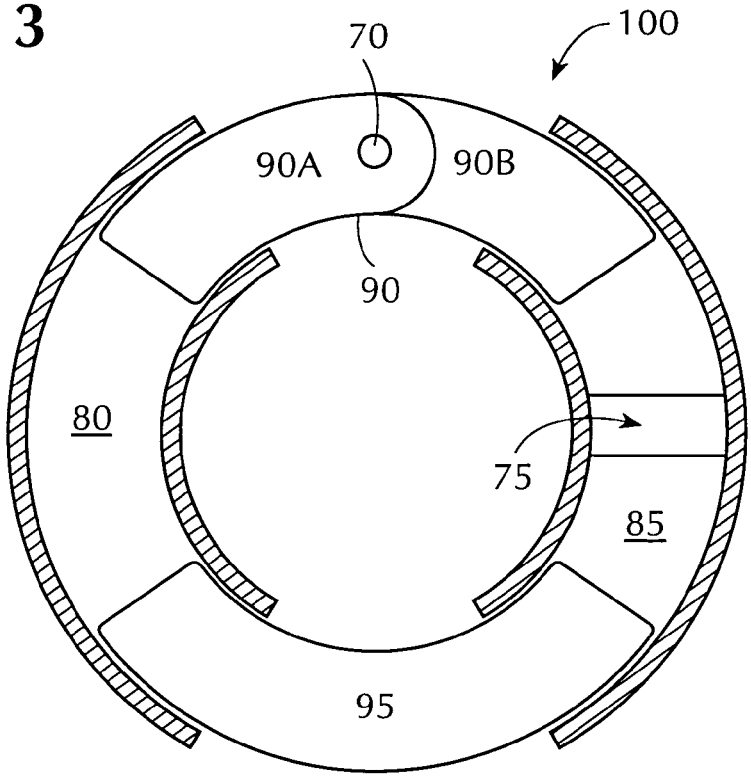
FIG. 3 is an illustration of a different configuration of a ring made of four magnetically mating jewelry-forming components according to the invention, with certain features illustrated in phantom.

In another preferred embodiment, a four-part ring 100 can be made in a slightly different way, as illustrated in FIG. 3, where two dual female elements 80, 85 can be connected to two dual male elements 90, 95. The male components can be provided with one type of magnetic force (i.e., positive or negative), while the female components can be provided with the opposite magnetic force so that these components may be magnetically coupled as shown. Alternatively, coupling may be achieved by providing each end of the female component with a different magnetic polarity and providing the mating male components with an opposite polarity to that of the female components.

Female component 80 is an arcuate tube the entire body of which is magnetized to one polarity while male component 95 is a solid arcuate rod that is magnetized with an opposite polarity to that of the female component 80. Male component 90 illustrates another feature of the invention, namely the use of a hinge 70 that allows the ends 90A, 90B of the male component to move relative to each other as those ends are slidingly coupled with the female elements 80, 85. Of course, male elements 90A, 90B would be magnetized with a polarity that is opposite to that of the female components 80, 85 so that those parts can be magnetically coupled.

Female component 85 illustrates an alternative embodiment, where a magnetized pellet or disk 75 having the opposite polarity to that of the polarized male components 90B, 95. This pellet or disk 75 can be inserted in the interior of the tubular female element 85 and spaced from the ends so that it can provide a magnetic force that attracts the opposite magnetic force of the male elements 90B, 95. This pellet or disk 75 can vary over a wide range of sizes and shapes, its only requirement being that it have a sufficient magnetic strength to attract the forward end of the male element in the manner described herein. Conveniently a circular disk, reminiscent of a miniature coin, as shown, is the easy to manufacture and assemble, and is preferred. This disk 75 can be adhered or otherwise affixed in place near the center of the cavity of the tubular female component 85 so that it cannot be dislodged or removed. The disk can be fixed in place using an adhesive, a solder, or a mechanical construction, such as a press fit, retaining screw or pin etc. In addition, the arcuate tube female component 85 can retain more than one disk therein, with each disk placed adjacent the final position of the male components therein. When a hollow tube is used, the disks can form the ends of the female cavities and act as a stop to the insertion of the male components. In the ring of FIG. 3, the male components are shown as arcuate, but they instead can be bent or straight rods that are magnetically attracted to the disk and that have an outer diameter or configuration that is smaller than the diameter of the tube opening.

The outer surface of the female element is generally illustrated as being uniform, but it also can be stepped or tapered as selected by the designer to achieve the desired visual effect. The taper presents a smooth transition between the male and female elements. The same is true for the design of the male element, keeping in mind that it must be shaped and size fit within the female element. Also, tapering of the male element can be used to provide a stop which prevents too great of a contraction of the size of the ring. Other stop members can be provided, such as pins, collars, stepped surfaces or the like. This stop member can also be controlled by the length of the male member and its abutting to the inside end of the female member. The female and male portions can be configured in any manner as described above so long as they allow the male elements to move easily into and out of the female elements. Also, as described above, the design of the female cavity and male end can be used to control the minimum size of the jewelry article.

Figure 4:
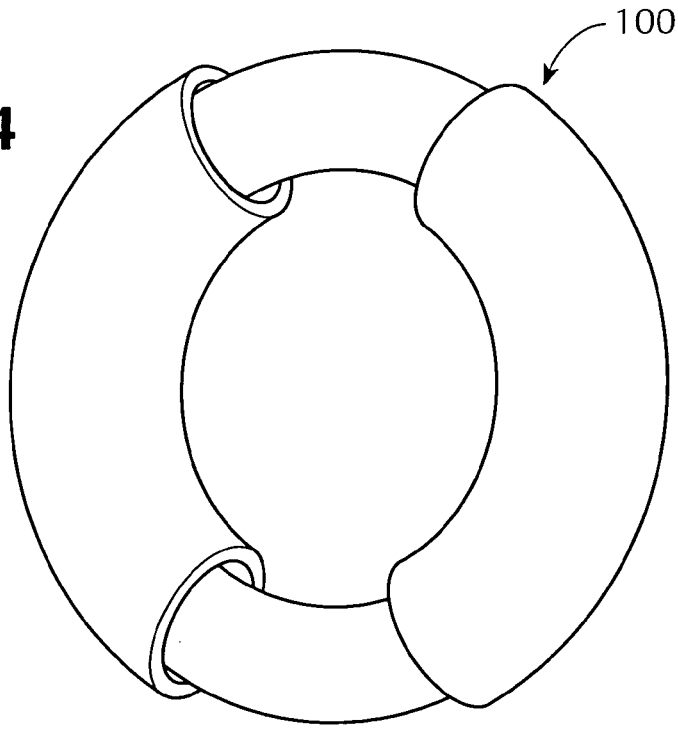
FIG. 4 is a view of the overall appearance of the ring of FIG. 3.

FIG. 4 illustrates the final ring 100 made of the jewelry-forming components of FIG. 3. Furthermore, differently adorned, colored or shaped male or female elements can be provided, so that rings of different appearance can be formed depending upon the desires of the user by combining different components. For example, the male elements can be made of a platinum alloy having a silver or white color while the female portions can be made of a magnetized gold colored alloy. Alternatively, different stones can be provided on different but interchangeable elements so that different appearances can be made based on the selection of the components to be magnetically combined in the ring.

Typical sizes for the jewelry-forming components of the invention can vary over a wide range. Generally, arcuate shaped components are used, but the designer has an unlimited selection of desirable sizes, shapes, colors, etc., depending upon the visual effects to be achieved, of course limited only by sizes that can be worn by the wearer without discomfort or injury.

Any magnetizable material can be used in the present invention, but for fine jewelry the invention preferably utilizes magnetic precious metal alloys that have magnetic properties and high hardness. These magnetic precious metal alloys are ideally suited for making various forms of fine jewelry that provide new and unusual visual and functional properties. The alloy's magnetic properties enable the components to either be attracted to or repelled by other components of different or like polarities. This, in turn, enables the jewelry designer to create a variety of precious metal pieces with magnetically connected components. A wide range of new precious metal jewelry components can now be made with heretofore unknown connections due to the magnetic properties of the alloys that are used therein.

The preferred alloys are platinum based and contain at least about 70% platinum by weight. While amounts as high as 95% by weight are suitable, the most preferred amount is between 75 and 80% by weight as these amounts enable the strongest magnetic properties to be achieved. In order to impart magnetic properties to these alloys, cobalt is added and the alloy is heat-treated. The amount of cobalt can range from about 5 to 30% by weight, and is complementary to the weight of the platinum. As between these two components, a weight ratio of 70:30 to 95:5 Pt:Co is preferable. An example of this material is known as POLARIUM® and is available from the inventor. This alloy is preferred for fine jewelry because it has greater magnetic power than known magnetic gold alloys.

The components of the invention can be used for many purposes. For example, a conventional necklace can be provided with a plurality of components that have oppositely polarized male (or female) elements extending away from the wearer. Then a plurality of ornamentations, such as gem or stone settings or metal shapes, e.g., cubes, polygons, figures, letters or numbers, etc., can be provided with a female (or male) element of opposite magnetic polarity to that of the male elements, This allows the user to connect the ornamentations onto the necklace in a desired manner by magnetically coupling the male and female elements. This arrangement allows the user to custom design the necklace for the occasion by adding the desired stones and other ornamentations, Moreover, since the couplings are not permanent, the necklace can be rearranged or redesigned as desired for future uses.

By including an appropriate post or clasp arrangement on one of the jewelry-forming component of the invention, the skilled artisan is able to create a wide range of earring designs from such components. In addition, one of ordinary skill in the art would recognize that the components of the invention can be used in combination with additional functional parts such as hinges, rivets, ball and socket joints, and other engineered items that allow for motion between the components. When a ball and socket type joint is used, the ball and socket can be magnetized with different polarities so that the can be maintained together in magnetic association. The final jewelry articles that can be made vary greatly, thus demonstrating the versatility of the jewelry-forming components of the invention.

What is claimed is:

1. A jewelry article comprising at least two jewelry-forming components, wherein a first jewelry-forming component comprises a body member having a first magnetized portion and a tubular female element associated therewith for magnetically attracting and receiving a tubular male element of another jewelry-forming component, and wherein a second jewelry-forming component comprises a body member having a magnetized portion and at least one tubular male element associated therewith that is magnetically attracted to the magnetized portion of the tubular female element of the first jewelry-forming component, with the magnetized portions of the components providing a minimum magnetic strength that is sufficient to retain the tubular male element within the tubular female element and a maximum magnetic strength that can be overcome by a person's hand strength to separate the male and female elements; and wherein the body member of the first component also includes a further element that is magnetically responsive for magnetically coupling with the second or another jewelry-forming component to form an article of jewelry, with the tubular female element of the first jewelry-forming component located at one end of the body member and having a tubular end portion with internal dimensions defining a cavity having a depth sufficient to receive the male element of the second jewelry-forming component, and the tubular male element of the second jewelry-forming component having a forward end with external dimensions that are smaller than the internal dimensions of the cavity of the female element of the first jewelry-forming component, so that the forward end of the tubular male element can be received at different positional relationships within the female element cavity to enable the article to be self-sizing to the wearer and with the magnetic strength between the elements enabling the user's hand force to withdraw the forward end of the male element from the cavity of the female element, and further wherein the further element of the first component is a tubular male element that extends away from the female element and is located on the opposite end of the body member, with the male element having a forward end that is magnetically attracted to a magnetically responsive tubular female element of the body member of the second or another jewelry-forming component.

2. The article of claim 1 wherein the body member of first magnetized portion of the body member is provided by a magnetized pellet or disk member.

3. The article of claim 2 in the form of a ring, bracelet, anklet, chain, choker, necklace, or watchband comprising a plurality of jewelry-forming components and a plurality of arcuate components having first and second male ends which are configured and dimensioned to be received and magnetically retained in the female elements of adjacent jewelry-forming components.

4. The article of claim 3 in the form of a ring comprising two jewelry-forming components and two arcuate male members that are magnetically interconnected.

5. The article of claim 3 in the form of a ring, bracelet, anklet, chain, choker, necklace, or watchband comprising between two and two hundred jewelry-forming components and between two and one hundred arcuate components.

6. The article of claim 1 in the form of a ring, bracelet, anklet, chain, choker, necklace, or watchband comprising a plurality of jewelry-forming components, wherein the male element of each component is magnetically coupled to the female element of each other component.

7. The article of claim 6, in the form of a ring, bracelet, anklet, chain, choker, necklace, or watchband comprising between two and two hundred jewelry-forming components are connected end to end.

8. The article of claim 6, in the form of a ring, wherein at least two to thirty components are connected end to end to form the ring.

9. A jewelry article comprising at least two jewelry-forming components, wherein a first jewelry-forming component comprises a body member having a first magnetized portion and a tubular female element associated therewith for magnetically attracting and receiving a tubular male element of another jewelry-forming component, and wherein a second jewelry-forming component comprises a body member having a magnetized portion and at least one tubular male element associated therewith that is magnetically attracted to the magnetized portion of the tubular female element of the first jewelry-forming component, with the magnetized portions of the components providing a minimum magnetic strength that is sufficient to retain the male element within the female element and a maximum magnetic strength that can be overcome by a person's hand strength to separate the male and female elements; and wherein the body member of the first component also includes a further element that is magnetically responsive for magnetically coupling with the second or another jewelry-forming component to form an article of jewelry, with the tubular female element of the first jewelry-forming component located at one end of the body member and having a tubular end portion with internal dimensions defining a cavity having a depth sufficient to receive the tubular male element of the second jewelry-forming component, and the tubular male element of the second jewelry-forming component having a forward end with external dimensions that are smaller than the internal dimensions of the cavity of the tubular female element of the first jewelry-forming component, so that the forward end of the male element can be received at different positional relationships within the female element cavity to enable the article to be self-sizing to the wearer and with the magnetic strength between the elements enabling the user's hand force to withdraw the forward end of the male element from the cavity of the female element, and further wherein the body member of the first component is tubular and the further element is another tubular female element located on an opposite end of the tubular body member and having a tubular end portion with internal dimensions defining a cavity having a depth sufficient to receive a male element of the second or another jewelry-forming component at different positional relationships therein.

10. The article of claim 9 wherein each female element of the first component is magnetized to attract oppositely polarized male elements.

11. The article of claim 10, wherein the first magnetized portion of the body member of the first component is provided by a magnetized pellet or disk member.

12. The article of claim 11 in the form of a ring, bracelet, anklet, chain, choker, necklace, or watchband comprising a plurality of jewelry-forming components.

13. The article of claim 9 in the form of a ring, bracelet, anklet, chain, choker, necklace, or watchband comprising a plurality of jewelry-forming components and a plurality of arcuate components having first and second male ends which are configured and dimensioned to be received and magnetically retained in the female elements of adjacent jewelry-forming components.

14. A jewelry article comprising a plurality of jewelry-forming components, with a first plurality of first jewelry-forming components each comprising a body member having a first magnetized portion and a tubular female element associated therewith for magnetically attracting and receiving a tubular male element of another jewelry-forming component, and a second plurality of second jewelry-forming components each comprising a body member having a magnetized portion and at least one tubular male element associated therewith that is magnetically attracted to the magnetized portion of the tubular female element of the first jewelry-forming component, with the magnetized portions of the components providing a minimum magnetic strength that is sufficient to retain the tubular male element within the tubular female element and a maximum magnetic strength that can be overcome by a person's hand strength to separate the male and female elements; and wherein the body member of each first component also includes a further element that is magnetically responsive for magnetically coupling with a further element of another jewelry-forming component, and further wherein the further element of each first jewelry-forming component is magnetically coupled to the further element of a second jewelry-forming component to form an article having a closed, continuous configuration, wherein the tubular female element of the first jewelry-forming component is located at one end of the body member and has a tubular end portion with internal dimensions defining a cavity having a depth sufficient to receive the tubular male element of the second jewelry-forming component, and the tubular male element of the second jewelry-forming component has a forward end with external dimensions that are smaller than the internal dimensions of the cavity of the female element of the first jewelry-forming component, so that the forward end of the male element can be received at different positional relationships within the female element cavity to enable the article to be self-sizing to the wearer and with the magnetic strength between the elements enabling the user's hand force to withdraw the forward end of the male element from the cavity of the female element.

15. The article of claim 14, in the form of a ring, bracelet, anklet, chain, choker, necklace, or watchband.

16. The article of claim 14 which further comprises a functional part for opening and closing the continuous configuration to facilitate connection or removal of the article for wearing.

17. The article of claim 16 wherein the functional part is a hinge.

18. The article of claim 14 wherein the body member has an arcuate shape.

19. A jewelry article in the form of a closed ring comprising between four and two hundred jewelry-forming components including at least two first jewelry-forming components and at least two second jewelry forming components, wherein each first jewelry-forming component comprises a body member having a first magnetized portion and a tubular female element associated therewith for magnetically attracting and receiving a tubular male element of another jewelry-forming component, and wherein each second jewelry-forming component comprises a body member having a magnetized portion and at least one tubular male element associated therewith that is magnetically attracted to the magnetized portion of the tubular female element of the first jewelry-forming component, with the magnetized portions of the components providing a minimum magnetic strength that is sufficient to retain the tubular male element within the tubular female element and a maximum magnetic strength that can be overcome by a person's hand strength to separate the male and female elements; and wherein the body member of each first jewelry-forming component also includes a further element that is magnetically responsive for magnetically coupling with the second or another jewelry-forming component to form the ring, with the tubular female element of each first jewelry-forming component located at one end of the body member and having a tubular end portion with internal dimensions defining a cavity having a depth sufficient to receive the male element of the second jewelry-forming component, and the tubular male element of the second jewelry-forming component having a forward end with external dimensions that are smaller than the internal dimensions of the cavity of the female element of the first jewelry-forming component, so that the forward end of the tubular male element can be received at different positional relationships within the female element cavity to enable the article to be self-sizing to the wearer and with the magnetic strength between the elements enabling the user's hand force to withdraw the forward end of the male element from the cavity of the female element, and further wherein the further element of each first component is either (a) a tubular male element that extends away from the female element and is located on the opposite end of the body member, with the male element having a forward end that is magnetically attracted to a magnetically responsive tubular female element of the body member of the second or another jewelry-forming component, or (b) another tubular female element located on an opposite end of the tubular body member and having a tubular end portion with internal dimensions defining a cavity having a depth sufficient to receive a male element of the second or another jewelry-forming component at different positional relationships therein, and with each second jewelry forming component including a corresponding further element that, respectively, is either (a) a tubular female element located on an opposite end of the body member and having a tubular end portion with internal dimensions defining a cavity having a depth sufficient to receive the male element of the first or another jewelry-forming component at different positional relationships therein, or (b) another tubular male element that is located on the opposite end of the body member, with the male element having a forward end that is magnetically attracted to a magnetically responsive tubular female element of the body member of the first or another jewelry-forming component.

* * * * *